US009335706B2

(12) United States Patent
Iikura

(10) Patent No.: US 9,335,706 B2
(45) Date of Patent: May 10, 2016

(54) CONTACT MEMBER, IMAGE CARRIER, AND IMAGE FORMING APPARATUS

(71) Applicant: FUJI XEROX CO., LTD., Tokyo (JP)

(72) Inventor: Kazuaki Iikura, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/539,347

(22) Filed: Nov. 12, 2014

(65) Prior Publication Data

US 2015/0370213 A1 Dec. 24, 2015

(30) Foreign Application Priority Data

Jun. 20, 2014 (JP) ..... 2014-127337

(51) Int. Cl.
*G03G 15/00* (2006.01)

(52) U.S. Cl.
CPC ..... *G03G 15/751* (2013.01)

(58) Field of Classification Search
CPC . G03G 15/751; G03G 15/757; G03G 21/186; B29C 59/16; B29C 2045/2714; B29C 45/2708
USPC ..... 399/91, 159, 351
See application file for complete search history.

(56) References Cited

U.S. PATENT DOCUMENTS 5,722,016 A 2/1998 Godlove et al.
5,904,329 A * 5/1999 Kanome ..... B65D 85/672 206/395
5,960,236 A 9/1999 Zaman et al.
6,406,656 B1 * 6/2002 Thompson ..... G03G 15/751 264/328.1
6,671,478 B2 * 12/2003 Litman ..... G03G 15/751 264/334

FOREIGN PATENT DOCUMENTS

| | | | |
|---|---|---|---|
| JP | 03-142215 | A | 6/1991 |
| JP | 06-017382 | | 3/1994 |
| JP | 08-044249 | | 2/1996 |
| JP | 08-054804 | | 2/1996 |
| JP | 08-062878 | | 3/1996 |
| JP | 09-277318 | | 10/1997 |
| JP | 11-208766 | | 8/1999 |
| JP | 11-309755 | | 11/1999 |
| JP | 2000-045968 | A | 2/2000 |
| JP | 2000-315036 | A | 11/2000 |
| JP | 2003-112332 | A | 4/2003 |
| JP | 2004-287360 | A | 10/2004 |
| JP | 2005-025134 | A | 1/2005 |
| JP | 2006-280039 | A | 10/2006 |
| JP | 2007-098698 | A | 4/2007 |
| JP | 2012-098538 | A | 5/2012 |
| JP | 2012-098539 | A | 5/2012 |
| JP | 05-296358 | B2 | 9/2013 |
| JP | 2014-102374 | A | 6/2014 |

* cited by examiner

*Primary Examiner* — Walter L Lindsay, Jr.
*Assistant Examiner* — Jessica L Eley
(74) *Attorney, Agent, or Firm* — Oliff PLC

(57) ABSTRACT

A contact member is supported in contact with an inside of a rotating cylindrical body, and is provided in a substantially arc shape along an inner side surface of the cylindrical body to have both end portions opposed to each other in a state in which the contact member is supported by the cylindrical body, when viewed from an axial direction of the cylindrical body. The contact member has a gate mark serving as an injection port for a resin material at a position recessed from an outer peripheral surface of the contact member.

6 Claims, 10 Drawing Sheets

CONTACT MEMBER, IMAGE CARRIER, AND IMAGE FORMING APPARATUS

CROSS-REFERENCE TO RELATED APPLICATIONS

This application is based on and claims priority under 35 USC 119 from Japanese Patent Application No. 2014-127337 filed Jun. 20, 2014.

BACKGROUND (i) Technical Field

The present invention relates to a contact member, an image carrier, and an image forming apparatus.

(ii) Related Art

In the past, contact members to be disposed within image carriers (photoconductor drums) have hitherto been formed by extrusion. However, contact members are sometimes formed by injection molding for cost reduction. In this case, when molding a contact member, a resin material is sometimes injected into a mold from a side of an outer peripheral surface of the contact member to increase accuracy of the outer peripheral surface.

However, the protrusion amount of a gate mark serving as an injection port for the resin material varies. For this reason, the vibration characteristics of an image carrier in which the contact member is disposed sometimes vary.

SUMMARY

According to an aspect of the invention, there is provided a contact member supported in contact with an inside of a rotating cylindrical body, and provided in a substantially arc shape along an inner side surface of the cylindrical body to have both end portions opposed to each other in a state in which the contact member is supported by the cylindrical body, when viewed from an axial direction of the cylindrical body. The contact member has a gate mark serving as an injection port for a resin material at a position recessed from an outer peripheral surface of the contact member.

BRIEF DESCRIPTION OF THE DRAWINGS

An exemplary embodiment of the present invention will be described in detail based on the following figures, wherein.

DETAILED DESCRIPTION

A contact member, an image carrier, and an image forming apparatus according to an exemplary embodiment of the present invention will be described with reference to FIGS. 1A and 1B to FIG. 9. In the figures, arrow H shows the apparatus up-down direction (vertical direction), arrow W shows the apparatus width direction (horizontal direction), and arrow D shows the apparatus depth direction (horizontal direction).

Overall Configuration

Figure 9:
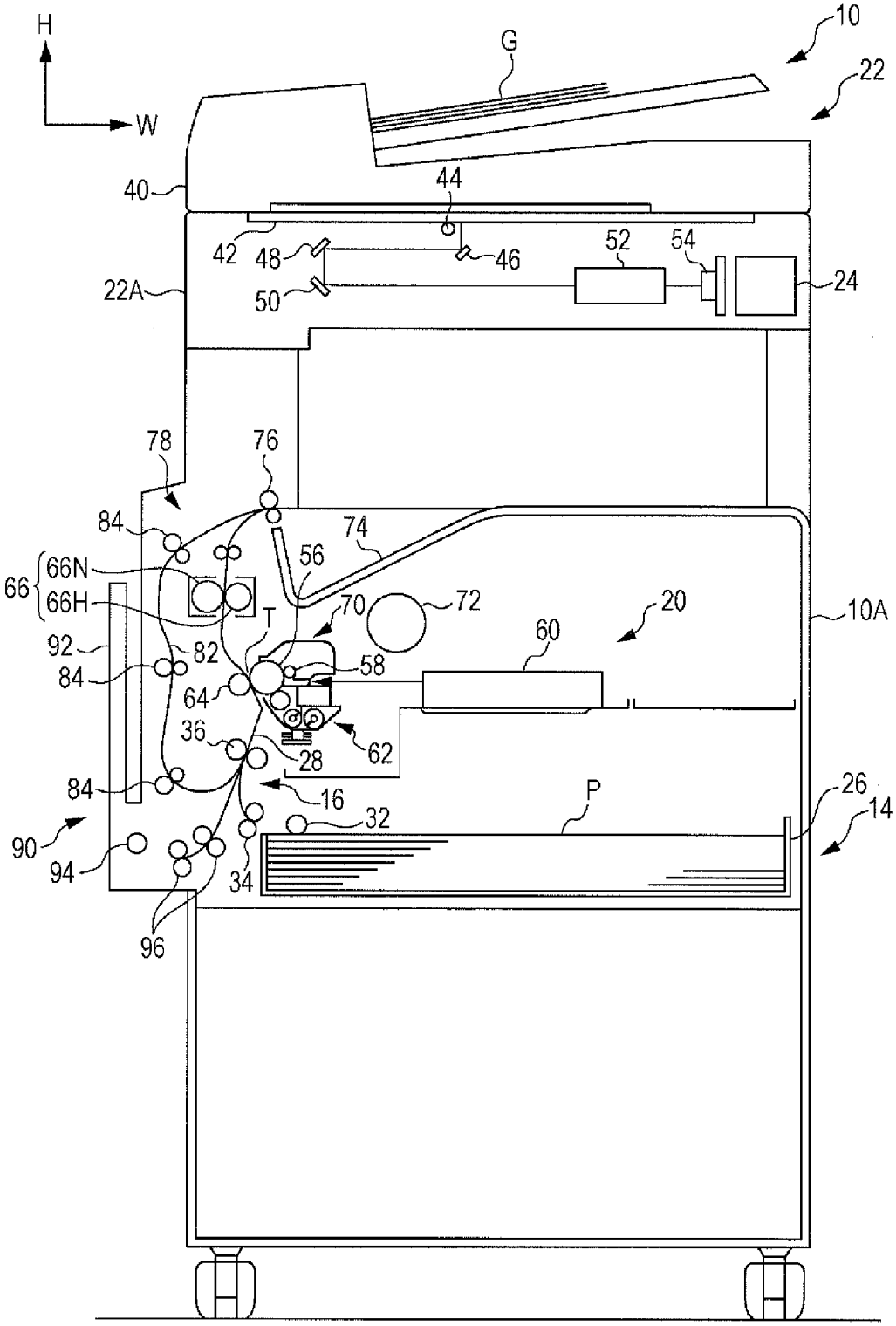
FIG. 9 is a schematic configuration view of an image forming apparatus according to the exemplary embodiment.

As illustrated in FIG. 9, in an image forming apparatus 10 according to the exemplary embodiment, a storage section 14, a transport section 16, an image forming section 20, and a document reading section 22 are provided in this order from a lower side toward an upper side in the apparatus up-down direction (direction of arrow H). The storage section 14 stores sheet members P serving as recording media. The transport section 16 transports the sheet members P stored in the storage section 14. The image forming section 20 forms images on the sheet members P transported from the storage section 14 by the transport section 16. The document reading section 22 reads a read document G. The image forming apparatus 10 further includes a manual paper feed section 90 from which a sheet member P is supplied manually.

Storage Section

The storage section 14 includes a storage member 26 that can be drawn out from an apparatus body 10A of the image forming apparatus 10 toward a front side in the apparatus depth direction. In the storage member 26, sheet members P are stacked. The storage section 14 further includes a feed roller 32 that feeds out the stacked sheet members P to a transport path 28 that configurates the transport section 16.

Transport Section

The transport section 16 includes separation rollers 34 disposed on a downstream side of the feed roller 32 in a transport direction of sheet members P (hereinafter simply referred to as a "transport-direction downstream side") to separate and transport the sheet members P one by one.

On the transport-direction downstream side of the separation rollers 34 in the transport path 28, registration rollers 36 are disposed to temporarily stop a sheet member P and to feed out the sheet member P to a transfer position T (to be described later) at a predetermined timing.

At a terminal end of the transport path 28, output rollers 76 are disposed to output a sheet member P, on which an image is formed by the image forming section 20, into an output portion 74 provided above the image forming section 20.

To form images on both sides of a sheet member P, a double-side transport unit 78 for inverting the sheet member P is provided in a side part of the apparatus body 10A. The double-side transport unit 78 includes a reverse path 82 into which a sheet member P is transported by reversing the output rollers 76. Further, plural transport rollers 84 are disposed along the reverse path 82. The sheet member P sent by the transport rollers 84 is transported to the registration rollers 36 again in an inverted state.

Manual Paper Feed Section

Next to the double-side transport unit 78, the folding manual paper feed section 90 is provided. The manual paper feed section 90 includes an openable manual paper feed member 92. The manual paper feed section 90 further includes a paper feed roller 94 and plural transport rollers 96 that transport a sheet member P fed from the open manual paper feed member 92. The sheet member P transported by the transport rollers 96 is transported to the registration rollers 36.

Document Reading Section

The document reading section 22 provided in the upper part of the image forming apparatus 10 includes a light source 44 that radiates light onto a read document G transported by an automatic document transport device 40 for transporting the read document G or a read document G placed on a platen glass 42.

The document reading section 22 further includes an optical system configurated by a full-rate mirror 46, a half-rate mirror 48, a half-rate mirror 50, and an imaging lens 52. Light radiated from the light source 44 is reflected by a read document G, and the reflected light is reflected by the full-rate mirror 46 in a direction parallel to the platen glass 42. The half-rate mirror 48 reflects the reflected light from the full-rate mirror 46 in a downward direction. The half-rate mirror 50 reflects and folds back the reflected light from the half-rate mirror 48 in the direction parallel to the platen glass 42. The reflected light folded back by the half-rate mirror 50 enters the imaging lens 52.

The document reading section 22 further includes a photoelectric conversion element 54 that converts the reflected light imaged by the imaging lens 52 into electric signals, and an image processing unit 24 that subjects the electric signals converted by the photoelectric conversion element 54 to image processing.

The light source 44, the full-rate mirror 46, the half-rate mirror 48, and the half-rate mirror 50 are movable along the platen glass 42. To read a read document G placed on the platen glass 42, the light source 44 radiates light onto the read document G while moving the light source 44, the full-rate mirror 46, the half-rate mirror 48, and the half-rate mirror 50. Reflected light from the read document G is imaged on the photoelectric conversion element 54.

To read a read document G transported by the automatic document transport device 40, the light source 44, the full-rate mirror 46, the half-rate mirror 48, and the half-rate mirror 50 are stopped. The light source 44 radiates light onto the read document G, and reflected light from the read document G is imaged on the photoelectric conversion element 54.

Image Forming Section

Figure 8:
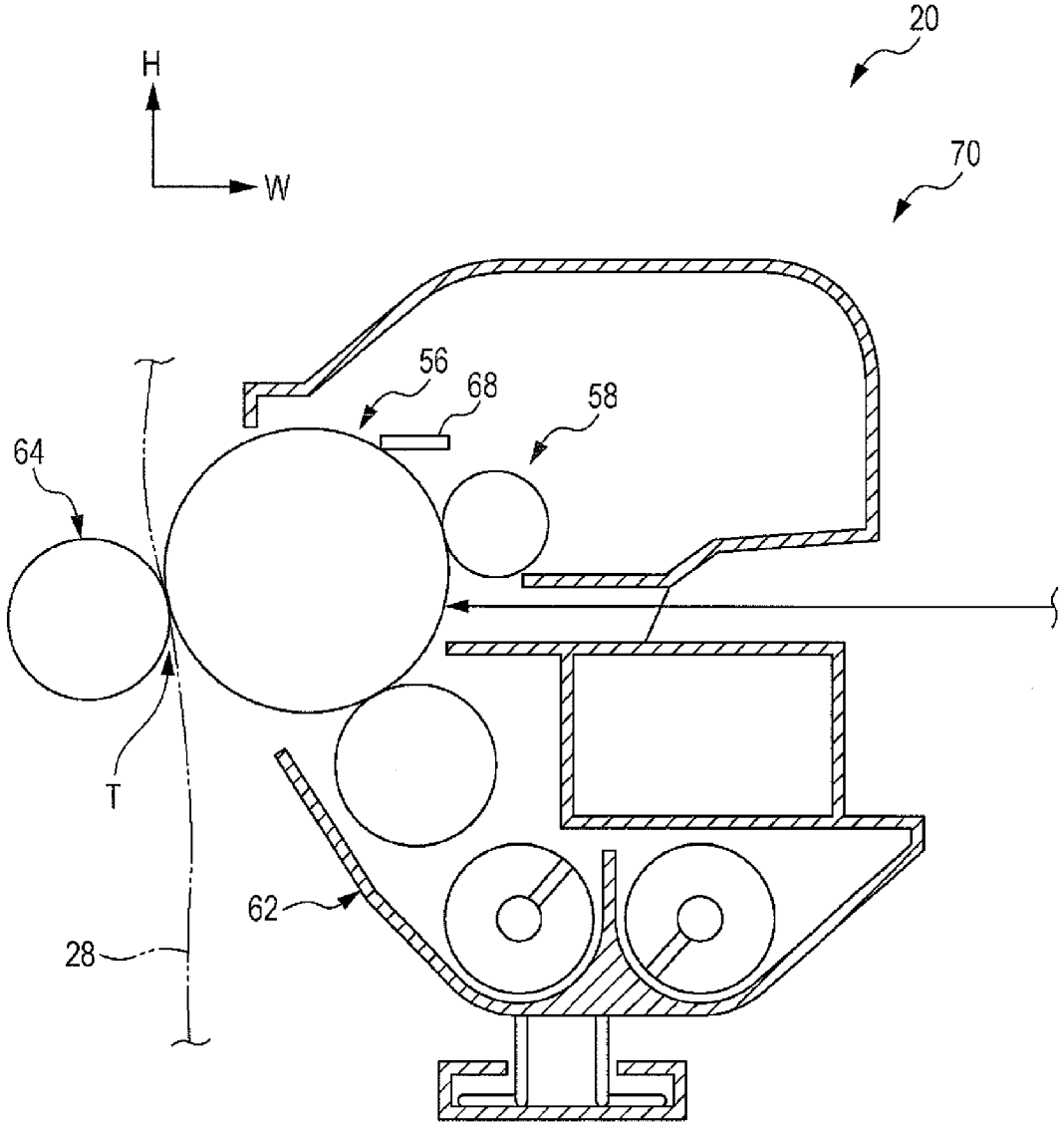
FIG. 8 is a structural view illustrating the image carrier and so on according to the exemplary embodiment.

As illustrated in FIG. 8, the image forming section 20 includes an image carrier 56, a charging roller 58 (an example of a charging member), an exposure device 60 (an example of an image forming member, see FIG. 9), and a developing device 62 (an example of an image forming member). The charging roller 58 charges a surface of the image carrier 56. The exposure device 60 forms an electrostatic latent image by radiating exposure light onto the charged surface of the image carrier 56 according to image data. The developing device 62 develops the electrostatic latent image into a visible toner image.

The image forming section 20 further includes a transfer roller 64, a fixing device 66 (see FIG. 9), and a cleaning blade 68. The transfer roller 64 transfers a toner image formed on the surface of the image carrier 56 onto a sheet member P transported along the transport path 28. The fixing device 66 is composed of a heating roller 66H and a pressurizing roller 66N, and fixes the toner image on the sheet member P with heat and pressure. The cleaning blade 68 cleans the image carrier 56 by scraping residual toner off the image carrier 56 after the toner image is transferred.

As illustrated in FIG. 9, a toner cartridge 72 connected to the developing device 62 by an unillustrated supply pipe is disposed on an obliquely upper side of the exposure device 60. The toner cartridge 72 stores toner to be supplied to the developing device 62 through the supply pipe.

In this configuration, when a sheet member P is fed out from the registration rollers 36, it is transported to the transfer position T defined by the image carrier 56 and the transfer roller 64 and is transported while being nipped therebetween. Thus, a toner image formed on the image carrier 56 is transferred onto the sheet member P.

Here, the image carrier 56, the charging roller 58, the developing device 62, and the cleaning blade 68 configurate an image forming unit 70. The image forming unit 70 is removably mounted in the apparatus body 10A.

The image carrier 56, the charging roller 58, and so on will be described in detail later.

Operation of Overall Configuration

In the image forming apparatus 10, an image is formed in the following procedure.

First, the charging roller 58 to which voltage is applied uniformly and negatively charges the surface of the image carrier 56 with a predetermined potential. Next, the exposure device 60 forms an electrostatic latent image by radiating exposure light onto the charged surface of the image carrier 56 on the basis of image data read by the document reading section 22 or externally input data.

The electrostatic latent image corresponding to the image data is thereby formed on the surface of the image carrier 56. This electrostatic latent image is developed into a visible toner image by the developing device 62.

A sheet member P is fed out from the storage member 26 into the transport path 28 by the feed roller 32 or is fed from the manual paper feed member 92 into the transport path 28 by the paper feed roller 94, and is sent to the transfer position T by the registration rollers 36 at a predetermined timing. At the transfer position T, the sheet member P is transported while being nipped between the image carrier 56 and the transfer roller 64, and the toner image formed on the surface of the image carrier 56 is thereby transferred onto a front surface of the sheet member P.

The transferred toner image is fixed on the sheet member P by passing between the heating roller 66H and the pressurizing roller 66N provided in the fixing device 66. Then, after the toner image is fixed on the front surface of the sheet member P, the sheet member P is output to the output portion 74 by the output rollers 76.

To also form an image on a back surface of the sheet member P, the sheet member P having the toner image on the front surface is not output to the output portion 74, but is sent to the reverse path 82 by reversing the output rollers 76. Thus, the sheet member P is inverted, and the transport rollers 84 transport the sheet member P to the registration rollers 36 again.

This time, a toner image is transferred onto the back surface of the sheet member P at the transfer position T, and the sheet member P is then output to the output portion 74 in the above-described procedure.

Structure of Principal Part

Next, the image carrier 56, the charging roller 58, and so on will be described.

Charging Roller

Figure 7:
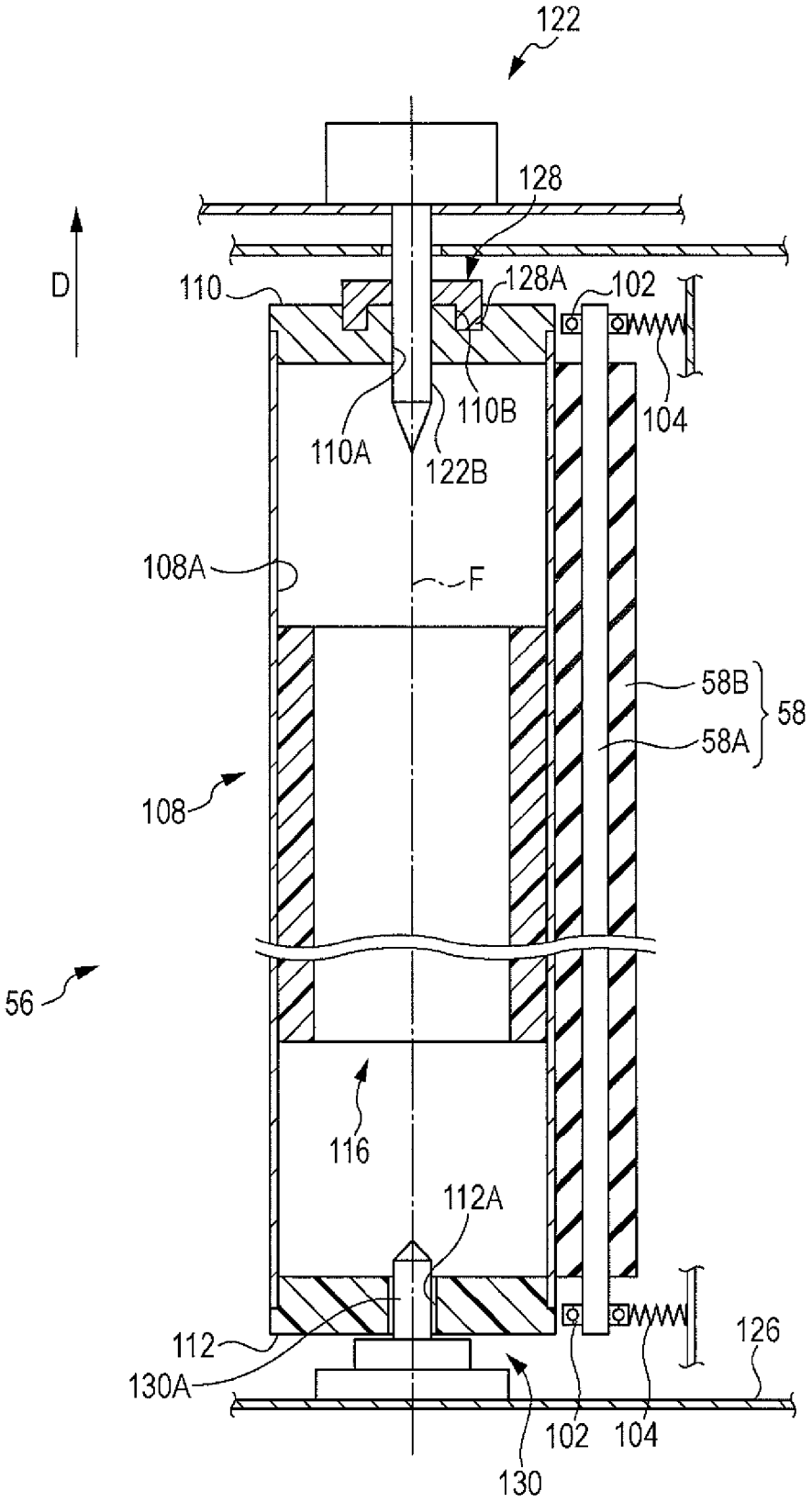
FIG. 7 is a cross-sectional view of an image carrier according to the exemplary embodiment.

As illustrated in FIG. 7, the charging roller 58 includes a shaft portion 58A extending in the apparatus depth direction and made of a metal material (for example, stainless steel), and a roller portion 58B made of a rubber material and formed in the shape of a cylinder through which the shaft portion 58A extends.

Both ends of the shaft portion 58A are exposed outside from the roller portion 58B, and are rotatably supported by a pair of bearing members 102. Biasing members 104 for biasing the bearing members 102 toward the image carrier 56 are disposed on a side of the shaft portion 58A opposite from the image carrier 56.

With this structure, the roller portion 58B of the charging roller 58 is pressed against the image carrier 56. When the image carrier 56 rotates, the charging roller 58 is rotated along with the rotation. To the shaft portion 58A, a superimposed voltage obtained by superimposing an alternating-current voltage (1 to 2 kHz) on a direct-current voltage is applied from an unillustrated power supply. Thus, current flows from the charging roller 58 to the image carrier 56, and the surface of the image carrier 56 is charged.

Image Carrier

As illustrated in FIG. 7, the image carrier 56 includes a cylindrical body 108, a transmission member 110, and a support member 112. The cylindrical body 108 extends in the apparatus depth direction and is shaped like a cylinder. The transmission member 110 is fixed to one end (upper side in FIG. 7) of the cylindrical body 108 in the apparatus depth direction (direction similar to the axial direction of the cylindrical body 108). The support member 112 is fixed to the other end (lower side in FIG. 7) of the cylindrical body 108 in the apparatus depth direction. The image carrier 56 further includes a contact member 116 disposed within the cylindrical body 108 to suppress deformation of a cross section of the cylindrical body 108.

The cylindrical body 108 is obtained by forming a photosensitive layer on an outer peripheral surface of a cylindrical base member made of a metal material (for example, aluminum). For example, the cylindrical body 108 has a thickness of 0.8 mm, and a length of 250 mm in the apparatus depth direction.

The transmission member 110 is made of a resin material and formed in a disc shape. The transmission member 110 is fixed to the one end of the cylindrical body 108 with a part thereof being fitted in the cylindrical body 108, and closes the open one end of the cylindrical body 108. The transmission member 110 has a columnar through hole 110A on an axial center F of the cylindrical body 108. In an outer peripheral surface of the transmission member 110 facing outward in the apparatus depth direction, plural recesses 110B are provided such that the through hole 110A is located therebetween.

A motor shaft portion 122B of a motor 122 for generating rotating force to be transmitted to the transmission member 110 (image carrier 56) penetrates the through hole 110A of the transmission member 110. Also, a distal end portion 128A of a bracket 128 attached to the motor shaft portion 122B is bent and inserted in the recesses 110B of the transmission member 110.

The support member 112 is made of a resin material and formed in a disc shape. The support member 112 is fixed to the other end of the cylindrical body 108 with a part thereof being fitted in the cylindrical body 108, and closes the other open end of the cylindrical body 108. The support member 112 has a columnar through hole 112A on the axial center F of the cylindrical body 108.

A shaft portion 130A of a shaft member 130 that rotatably supports the support member 112 (image carrier 56) penetrates the through hole 112A, and the support member 112 functions as a so-called sliding bearing for the shaft portion 130A.

In this structure, rotating force generated by the motor 122 is transmitted to the transmission member 110 (image carrier 56) via the bracket 128, and rotates the image carrier 56 about the axial center F.

Contact Member

Next, a description will be given of the contact member 116 disposed within the cylindrical body 108 to suppress deformation of the cross section of the cylindrical body 108.

Figure 1A:
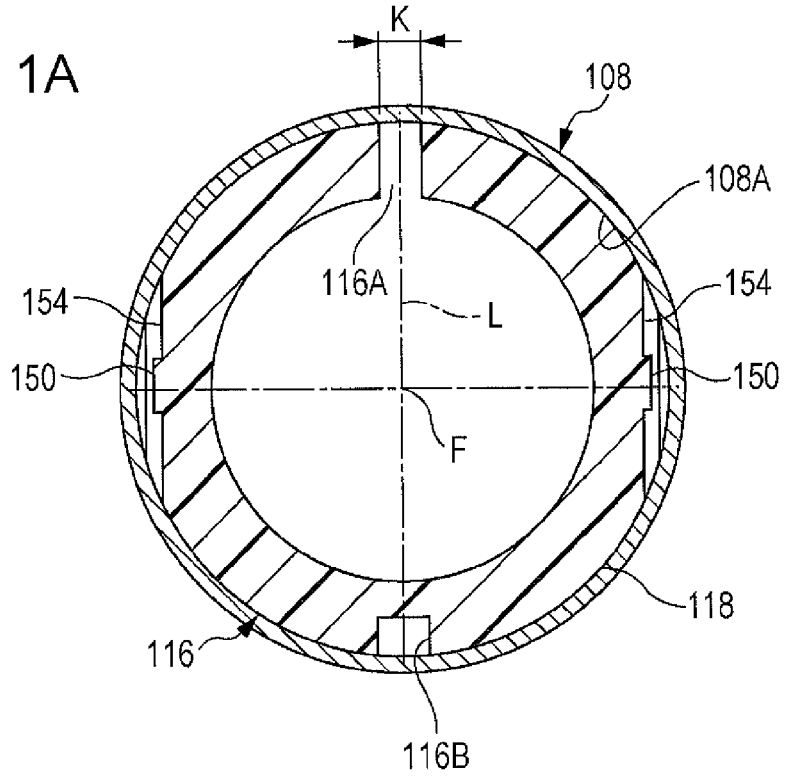
FIGS. 1A and 1B are cross-sectional views illustrating a state in which a contact member according to an exemplary embodiment is supported within a cylindrical body.

As illustrated in FIG. 7, the contact member 116 is fitted in the cylindrical body 108, and is located in the center of the cylindrical body 108 in the apparatus depth direction. As illustrated in FIG. 1A, the contact member 116 is supported by the cylindrical body 108 with an arc-shaped outer peripheral surface 118 thereof being in contact with an inner peripheral surface 108A of the cylindrical body 108.

Figure 3:
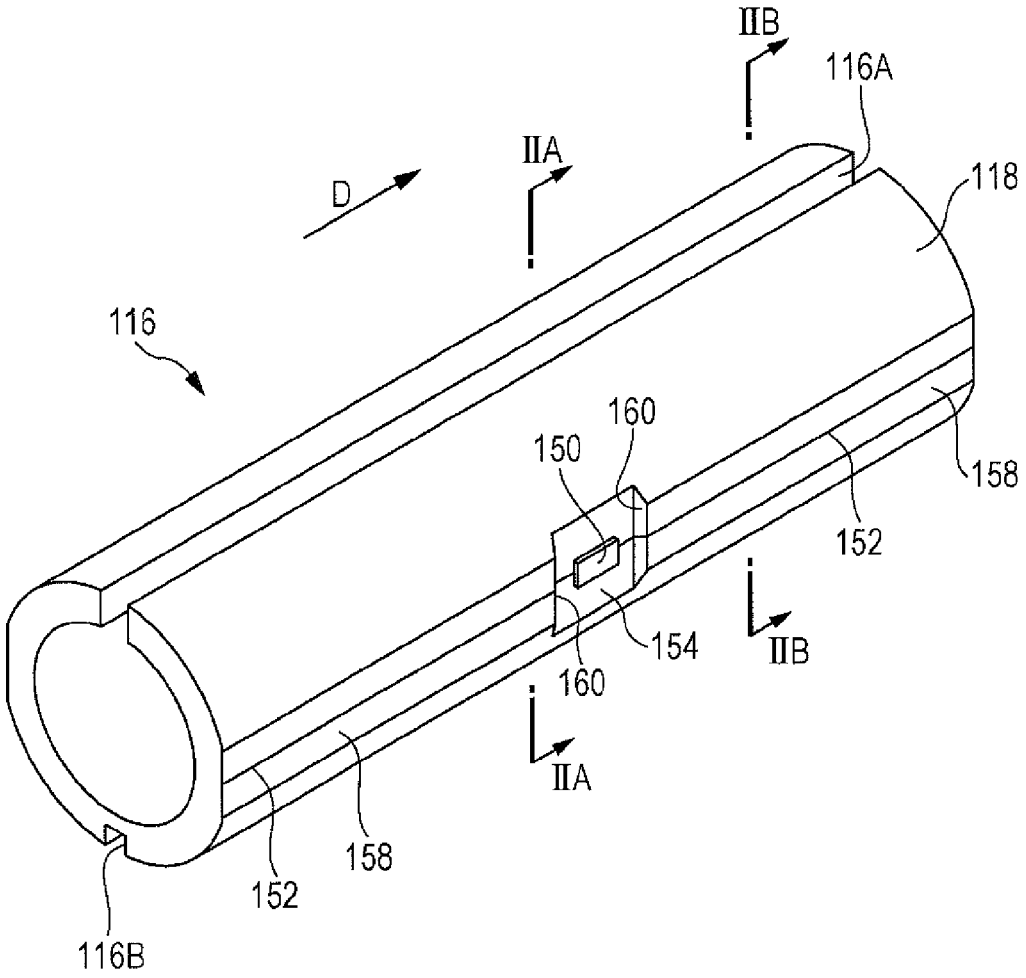
FIG. 3 is a perspective view of the contact member of the exemplary embodiment.

Specifically, the contact member 116 is made of a resin material (for example, ABS resin), and is formed by injection molding. The contact member 116 is arc-shaped (C-shaped) or substantially arc-shaped such that both end portions are opposed along the inner peripheral surface 108A of the cylindrical body 108, when viewed from the apparatus depth direction. Between the opposed end portions, the contact member 116 is partly separated to form a separate space 116A in the circumferential direction. As illustrated in FIG. 3, the contact member 116 extends in the apparatus depth direction. For example, the thickness of a general portion of the contact member 116 is 4 mm, and the length of the contact member 116 in the apparatus depth direction is 100 mm.

Further, as illustrated in FIG. 1A, a groove portion 116B extending in the apparatus depth direction is provided on a portion of the outer peripheral surface 118 of the contact member 116 on a side of the axial center F of the cylindrical body 108 opposite from the separate space 116A in a state in which the contact member 116 is disposed within the cylindrical body 108.

In a state in which the contact member 116 is not disposed within the cylindrical body 108 (see FIG. 2A), a separate distance (distance K in FIG. 2A) of the separate space 116A is longer than when the contact member 116 is disposed within the cylindrical body 108 (see FIG. 1A).

In this structure, when the contact member 116 is disposed within the cylindrical body 108, it is held and bent by deforming the groove portion 116B to shorten the separate distance K of the separate space 116A. In this state, the contact member 116 is inserted into the cylindrical body 108, the holding force is removed, and the contact member 116 is pushed into the center of the cylindrical body 108. Thus, the outer peripheral surface 118 of the contact member 116 comes into contact with the inner peripheral surface 108A of the cylindrical body 108, and the contact member 116 is disposed and supported within the cylindrical body 108.

Figure 2A:
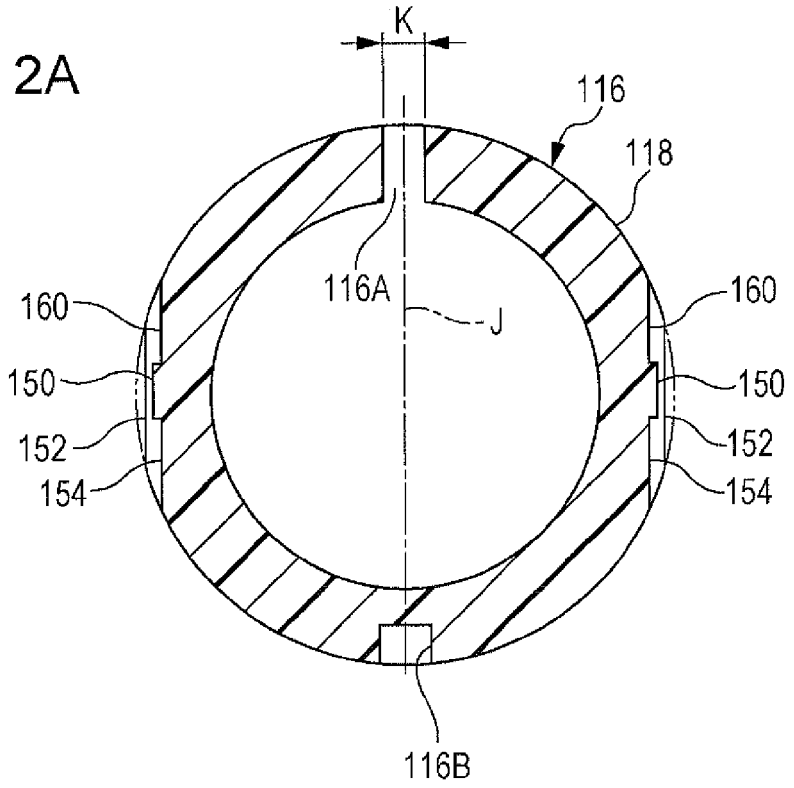
FIGS. 2A and 2B are cross-sectional views of the contact member of the exemplary embodiment.
Figure 2B:
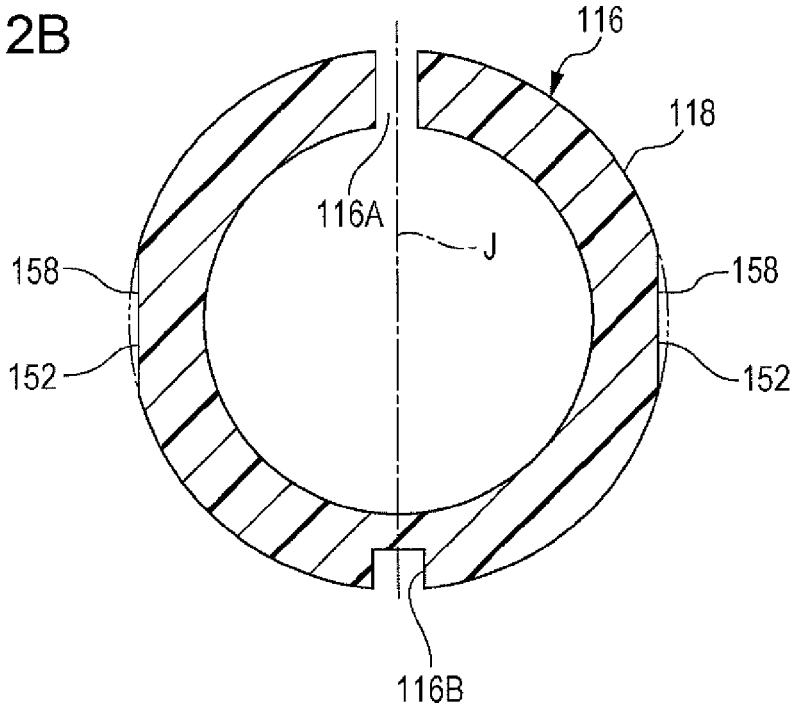

Next, a description will be given of gate marks 150 serving as injection ports for the resin material during injection molding of the contact member 116, and parting lines 152 where molds for injection molding meet. FIG. 2A is a cross-sectional view taken along line IIA-IIA of FIG. 3, and FIG. 2B is a cross-sectional view taken along line IIB-IIB of FIG. 3. The IIA-IIA cross-sectional view shows a cross section of the contact member 116 in the center in the apparatus depth direction, and the IIB-IIB cross-sectional view shows a cross section of the contact member 116 in the end portion in the apparatus depth direction.

As illustrated in FIG. 2A, the contact member 116 has two flat portions 154 that are recessed by, for example, about 0.8 mm from the outer peripheral surface 118. The two flat portions 154 are positioned symmetrically with respect to a straight line J passing through the center of the separate space 116A and the center of the groove portion 116B, when viewed from the apparatus depth direction. The flat portions 154 have their respective gate marks 150. As illustrated in FIG. 3, the flat portions 154 having the gate marks 150 are located in the center of the outer peripheral surface 118 in the apparatus depth direction. As illustrated in FIG. 2A, the flat portions 154 are each shaped like a straight line parallel to the straight line J, when viewed from the apparatus depth direction.

As illustrated in FIGS. 2B and 3, on both sides of the flat portions 154 in the apparatus depth direction, flat portions 158, which are recessed by, for example, about 0.6 mm from the outer peripheral surface 118, extend in the apparatus depth direction. The recess amount of the flat portions 158 from the outer peripheral surface 118 is less than the recess amount of the flat portions 154 (see FIGS. 2A and 2B). Base end portions of the flat portions 158 are connected to the flat portions 154 via stepped portions 160, and distal end portions of the flat portions 158 extend to the end portions of the contact member 116. As illustrated in FIG. 2B, the flat portions 158 are each shaped like a straight line parallel to the straight line J, when viewed from the apparatus depth direction.

In contrast, as illustrated in FIG. 3, the parting lines 152 are provided in the flat portions 154, the stepped portions 160, and the flat portions 158, and extend from the gate marks 150 to both ends in the apparatus depth direction with their end portions being in contact with the gate marks 150.

In this structure, as illustrated in FIG. 1A, the gate marks 150 are separate from the inner peripheral surface 108A of the cylindrical body 108 in a state in which the contact member 116 is supported within the cylindrical body 108.

Figure 1B:
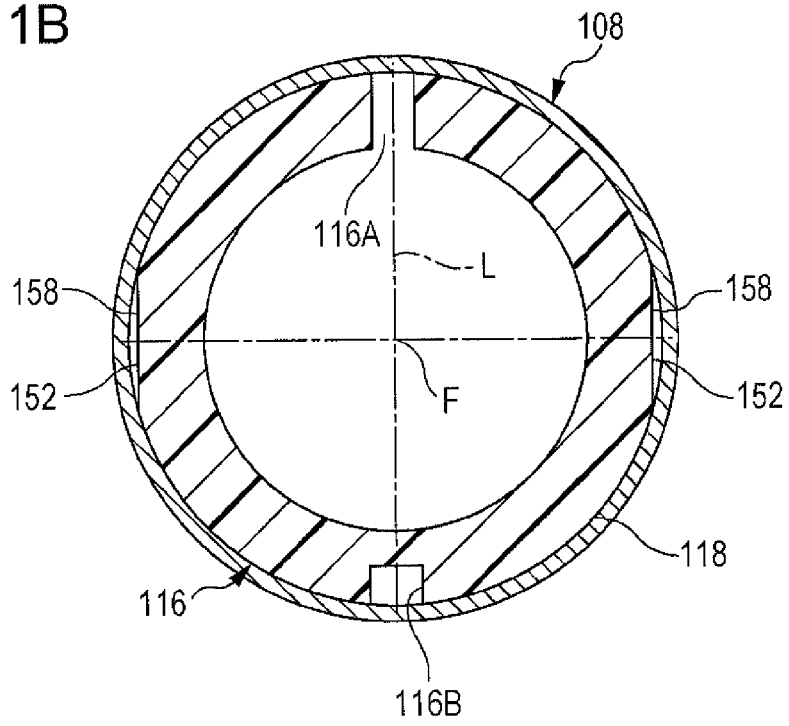

Similarly, as illustrated in FIG. 1B, the parting lines 152 are separate from the inner peripheral surface 108A of the cylindrical body 108 in the state in which the contact member 116 is supported within the cylindrical body 108.

As illustrated in FIG. 2A, the two gate marks 150 are symmetrically located with respect to the straight line J, when viewed from the apparatus depth direction. In other words, as illustrated in FIG. 1A, in the state in which the contact member 116 is supported within the cylindrical body 108, the two gate marks 150 are symmetrically located with respect to a straight line L passing through the center of the separate space 116A and the axial center F, when viewed from the apparatus depth direction. Further, the two gate marks 150 are located at similar positions in the apparatus depth direction. The gate marks 150 are regarded as being located at similar positions when even a part of one of the gate marks 150 overlaps with the other gate mark 150.

Mold Structure

Next, a mold mechanism 200 used to form the contact member 116 by injection molding will be described with reference to FIGS. 4A, 4B, 5A, 53, 6A, and 6B.

In the description of the mold mechanism 200, the longitudinal direction of the contact member 116 is referred to as a member longitudinal direction (arrow Z in FIGS. 4A and 4B to FIGS. 6A and 6B), and the extending direction of the above-described straight line J is referred to as a member up-down direction (arrow Y in FIGS. 4A and 4B to FIGS. 6A and 6B), when viewed from the member longitudinal direction. Further, the direction orthogonal to the member up-down direction is referred to as a member width direction (arrow X in FIGS. 4A and 4B to FIGS. 6A and 6B), when viewed from the member longitudinal direction.

Figure 4A:
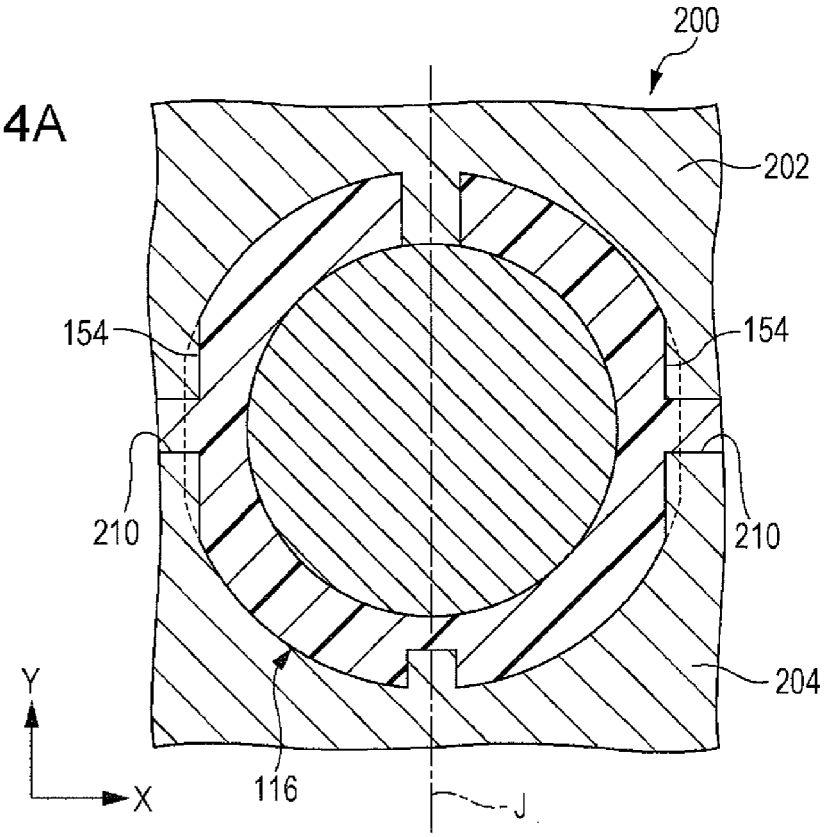
FIGS. 4A and 4B are cross-sectional views illustrating a mold structure used to mold the contact member of the exemplary embodiment.
Figure 4B:
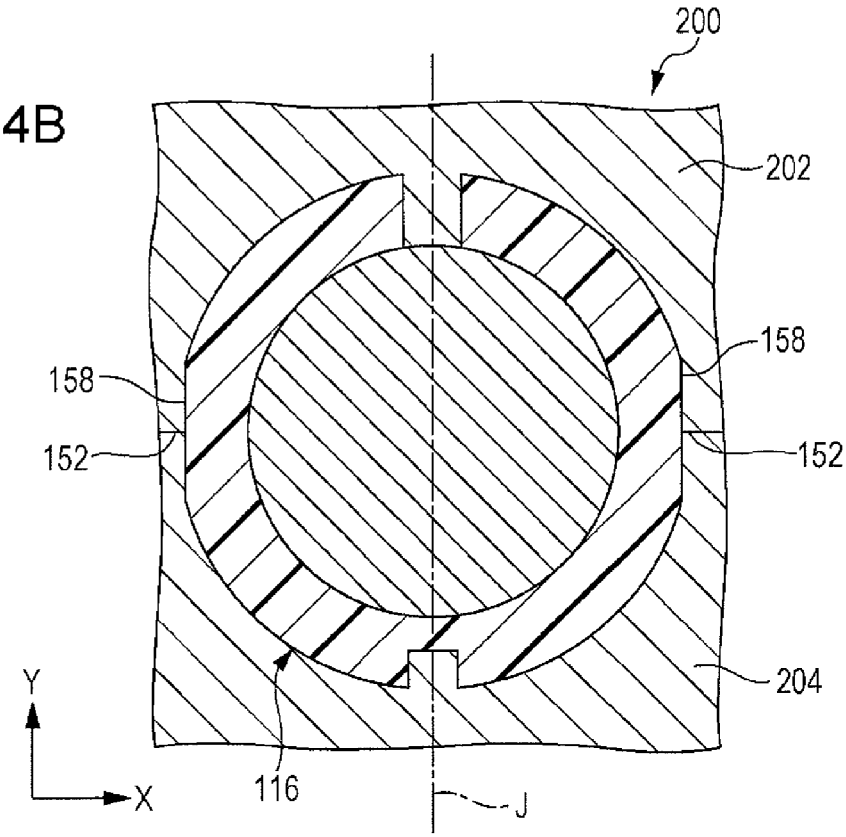
Figure 6A:
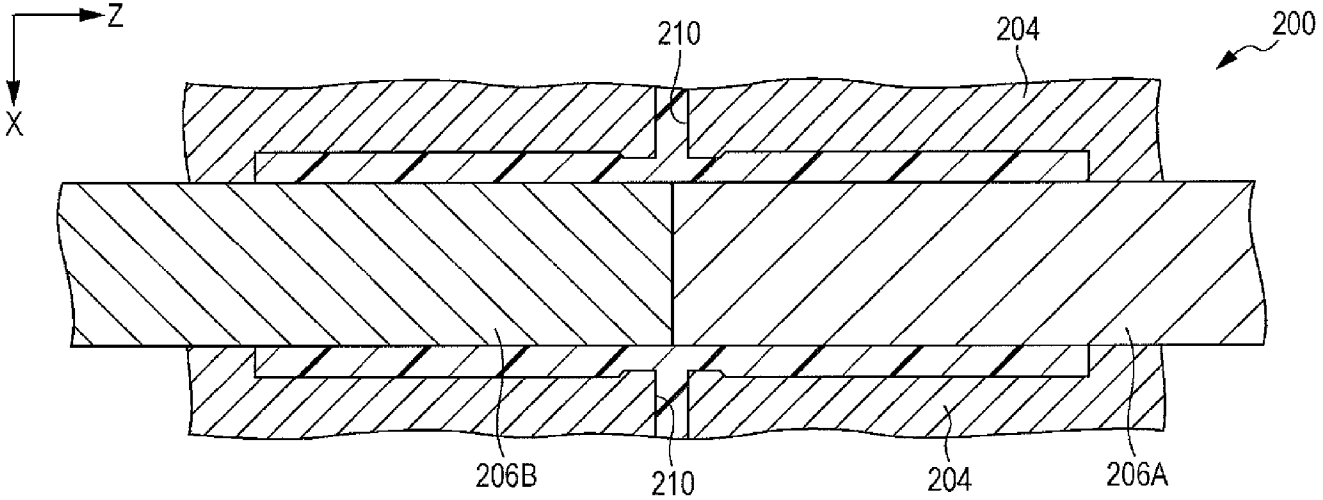
FIGS. 6A and 6B are cross-sectional views illustrating the mold structure used to mold the contact member of the exemplary embodiment.

As illustrated in FIGS. 4A and 4B, the mold mechanism 200 includes a cavity mold 202 (an example of a mold) to be in contact with an upper side in the member up-down direction of a surface of a contact member 116 facing outward, and a core mold 204 (an example of a mold) to be in contact with a lower side of the surface. As illustrated in FIG. 6A, the mold mechanism 200 further includes a pair of sliding molds 206A and 206B to be in contact with a surface of the contact member 116 facing inward.

Figure 5A:
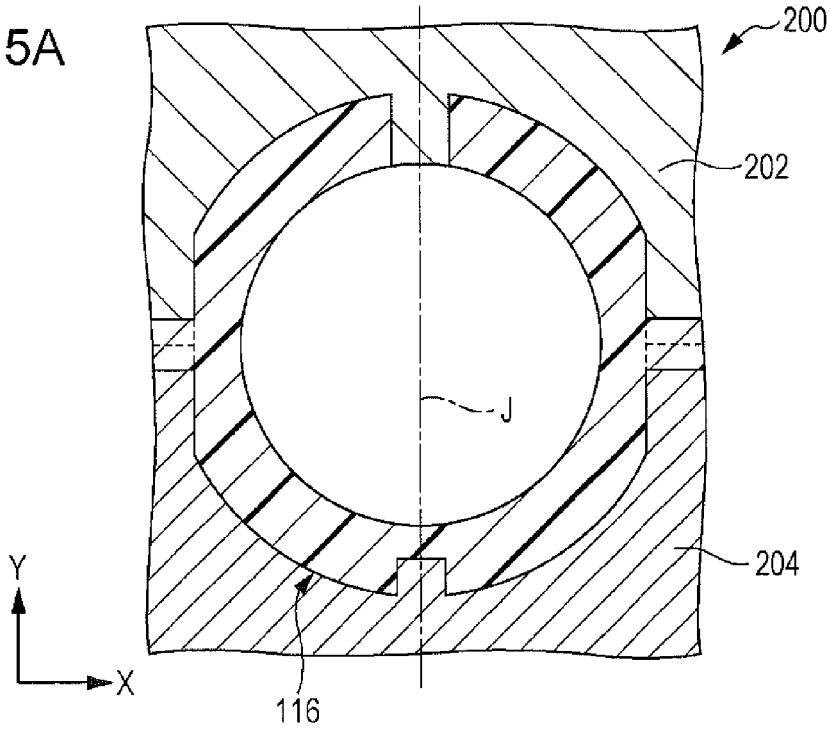
FIGS. 5A and 5B are cross-sectional views illustrating the mold structure used to mold the contact member of the exemplary embodiment.
Figure 5B:
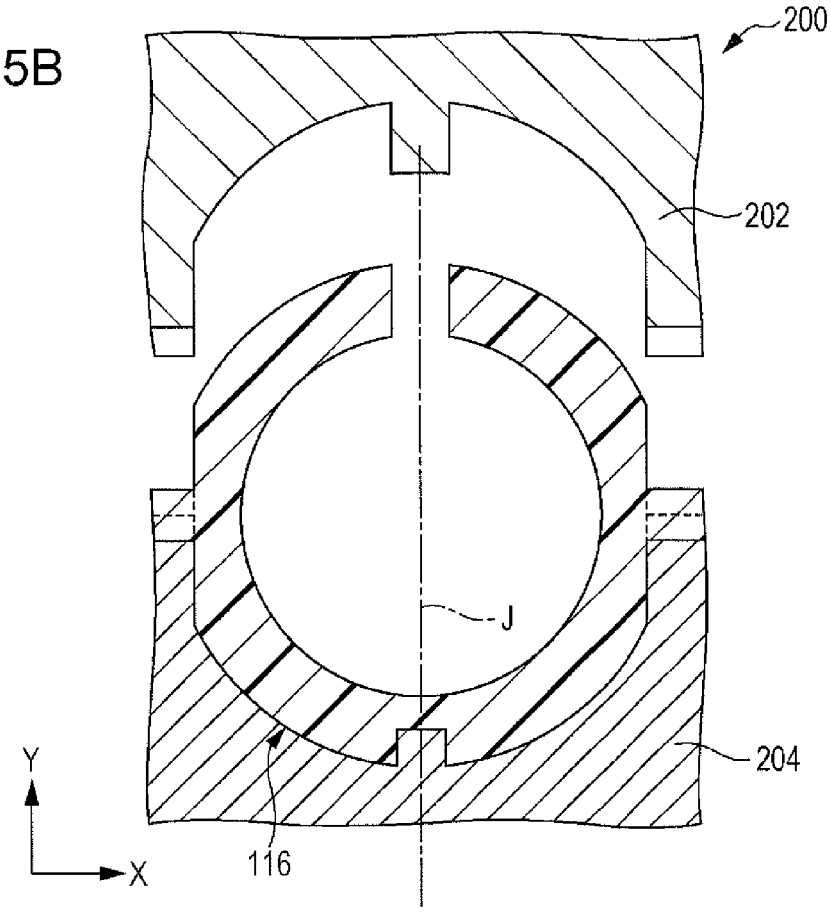
Figure 6B:
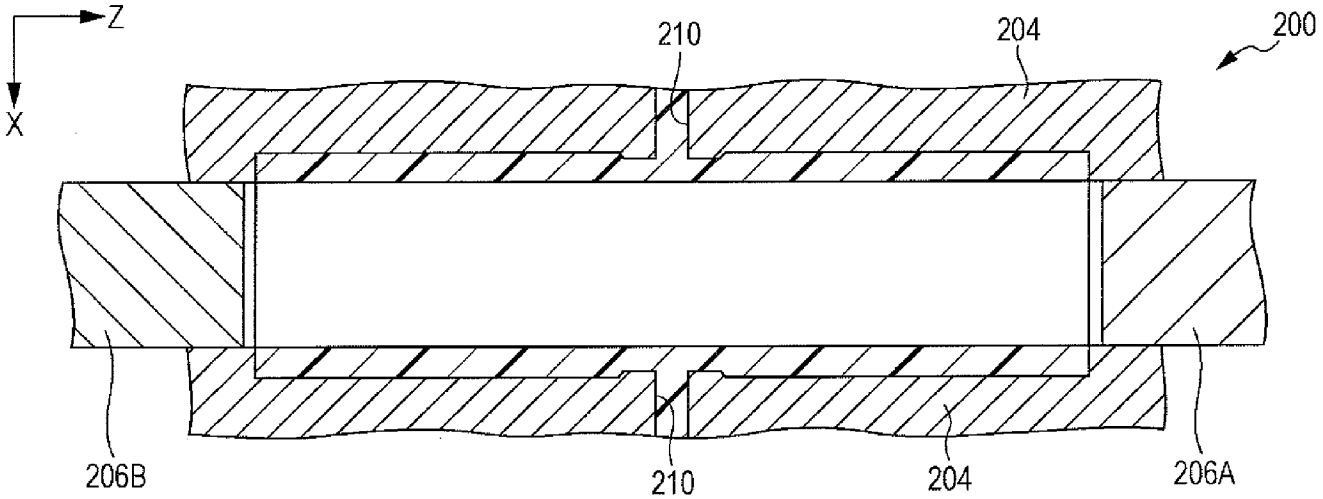

As illustrated in FIGS. 6A and 6B, the pair of sliding molds 206A and 206B are moved by an unillustrated moving member in the member longitudinal direction to separate from each other from a state in which the molds are set. As illustrated in FIGS. 5A and 5B, the cavity mold 202 is moved by an unillustrated moving member upward in the member up-down direction to separate from the core mold 204 from the state in which the molds are set.

Further, as illustrated in FIGS. 4A and 6A, in the center of the mold mechanism 200 in the member longitudinal direction, two gate portions 210 through which a melted resin material flows are provided symmetrically with respect to the straight line J (see FIG. 4A).

In this structure, the melted resin material is injected into the mold mechanism 200 from the gate portions 210 in the state in which the molds are set, and is then solidified (cured) by cooling. Then, as illustrated in FIGS. 6A and 6B, the sliding molds 206A and 206B are moved in the member longitudinal direction to separate from each other. Further, as illustrated in FIGS. 5A and 5B, the cavity mold 202 is moved upward in the member up-down direction. Then, a resin member is demolded and the gates are cut, so that a contact member 116 is formed.

The protrusion amount of gate marks 150 remaining after gate cutting varies among components. The gate marks 150 sometimes protrude by a maximum of about 0.4 mm from the flat portions 154. If the cavity mold 202 and the core mold 204 are misaligned, the height difference at the parting lines 152 varies among components. The height difference at the parting line 152 sometimes becomes about 0.4 mm at the maximum.

Operation of Principal Structure

Next, the operations of the image carrier 56, the charging roller 58, and so on will be described.

When the motor 122 is operated, the image carrier 56 rotates (see FIG. 7). When the image carrier 56 rotates, the charging roller 58 is rotated along with the rotation. To charge the unillustrated photosensitive layer of the image carrier 56, a superimposed voltage obtained by superimposing an alternating-current voltage (1 to 2 kHz) on a direct-current voltage is applied from the power supply to the shaft portion 58A of the charging roller 58.

By the alternating-current voltage included in the superimposed voltage, an alternating electric field is generated between the charging roller 58 and the image carrier 56. Thus, a periodic electrostatic attractive force (2 to 4 kHz) is generated between the image carrier 56 and the charging roller 58.

Here, an image carrier 250 according to a comparative example will be described in contrast to the image carrier 56 of the exemplary embodiment with reference to FIGS. 10A and 10B.

First, the image carrier 250 will be described. The image carrier 250 has a structure similar to that of the image carrier 56 except that the contact member 116 is not provided.

Figure 10A:
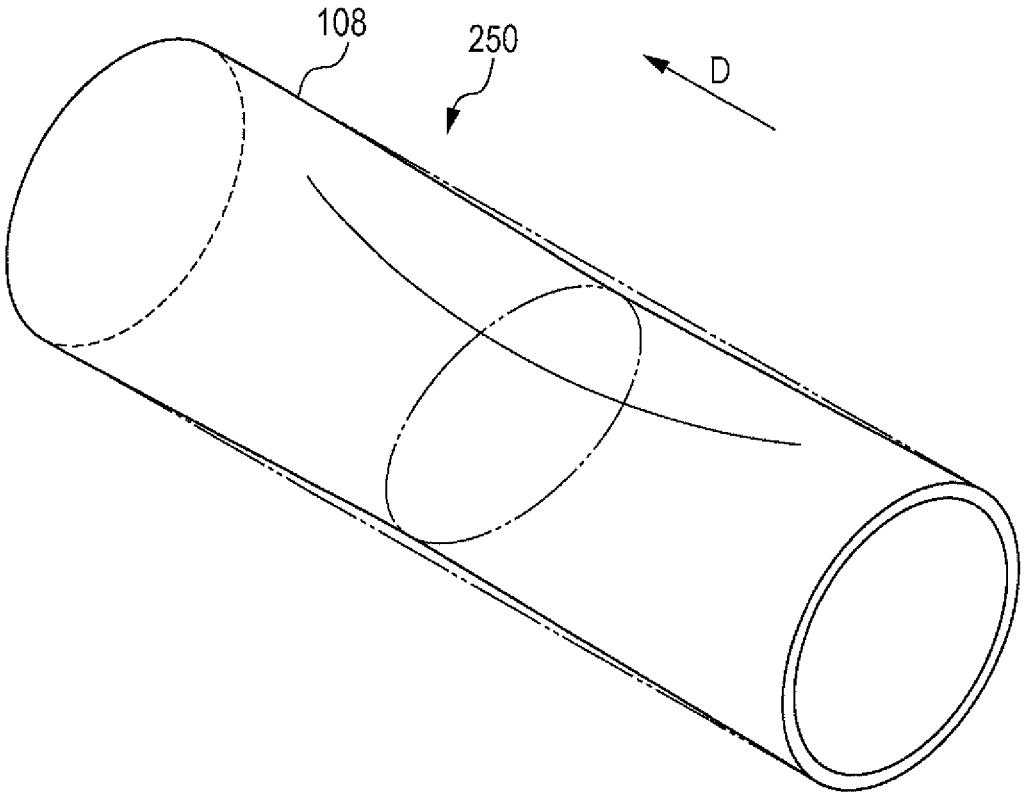
FIGS. 10A and 10B are a perspective view and a cross-sectional view, respectively, of an image carrier according to a comparative example in contrast to the image carrier of the exemplary embodiment.
Figure 10B:
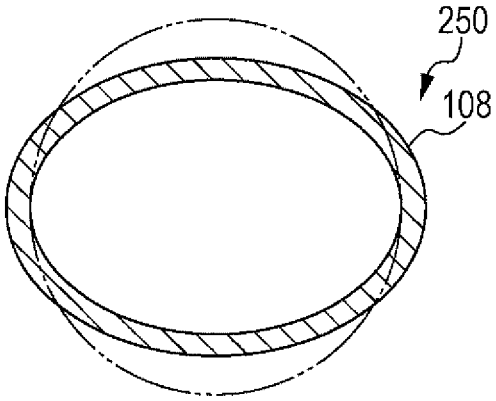

FIGS. 10A and 10B exaggeratedly illustrate an example of a deformed state of a cylindrical body 108 of the image carrier 250 when a periodic electrostatic attractive force is generated between the image carrier 250 and a charging roller 58. Since a transmission member 110 and a support member 112 are fixed to opposite ends of the cylindrical body 108 in the apparatus depth direction (see FIG. 7), deformation of a cross section of the cylindrical body 108 is suppressed at the opposite ends in the apparatus depth direction. In contrast, in the center portion of the cylindrical body 108 in the apparatus depth direction, the cross section of the cylindrical body 108 periodically deforms in an elliptic shape and a circular shape, as illustrated in FIG. 10B.

However, unlike the image carrier 250 of the comparative example, the image carrier 56 of the exemplary embodiment is provided with the contact member 116. As illustrated in FIGS. 1A and 1B, the contact member 116 is supported by the cylindrical body 108 with the outer peripheral surface 118 being in contact with the inner peripheral surface 108A of the cylindrical body 108.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

For example, the contact member 116 has the groove portion 116B and is bent and placed within the cylindrical body 108 while deforming the groove portion 116B in the exemplary embodiment. However, it is not always necessary to form the groove portion 116B. When being placed within the cylindrical body 108, the contact member 116 may be bent entirely.

While the gate marks 150 are provided at two positions in the exemplary embodiment, a gate mark 150 may be provided at one position or three or more positions.

While the two gate marks 150 are located in the center portion in the apparatus depth direction in the exemplary embodiment, it is only necessary that the two gate marks 150 should be located at similar positions in the apparatus depth direction.

While the stepped portions 160 are provided in the contact member 116 in the exemplary embodiment, they do not always need to be provided.

What is claimed is:

1. A contact member supported in contact with an inside of a rotating cylindrical body, and provided in a substantially arc shape along an inner side surface of the cylindrical body to have both end portions opposed to each other in a state in which the contact member is supported by the cylindrical body, when viewed from an axial direction of the cylindrical body, the contact member having a gate mark serving as an injection port for a resin material at a position recessed from an outer peripheral surface of the contact member, the gate mark extending radially outwardly from within a recessed flat portion along the outer peripheral surface of the contact member such that a gap is formed between a radially outer end of the gate mark and an inner peripheral surface of the rotating cylindrical body.

2. The contact member according to claim 1, wherein the gate mark includes two gate marks, and wherein, in the state in which the contact member is supported by the cylindrical body, the two gate marks are located symmetrically with respect to a straight line passing through a center of a separate space provided between the opposed end portions and a center of the cylindrical body, when viewed from the axial direction.

3. The contact member according to claim 2, wherein the two gate marks are located at similar positions in the axial direction.

4. The contact member according to claim 1, wherein a parting line where molds meet is provided at a position recessed from the outer peripheral surface.

5. An image carrier comprising:

a rotating cylindrical body whose surface is to be charged; and the contact member according to claim 1, the contact member being fitted within the cylindrical body.

6. An image forming apparatus comprising:

the image carrier according to claim 5;

a charging member to which a superimposed voltage obtained by superimposing an alternating-current voltage on a direct-current voltage is applied to charge the surface of the image carrier; and an image forming member that forms an image on the charged surface of the image carrier.

* * * * *